US011834837B2

(12) United States Patent
Wang et al.

(10) Patent No.: US 11,834,837 B2
(45) Date of Patent: Dec. 5, 2023

(54) LOUVER AWNING WITH HIDDEN LOUVER OPENING AND CLOSING DRIVING STRUCTURE

(71) Applicant: Linhai Meiyang Parasol Industry Co., Ltd, Zhejiang (CN)

(72) Inventors: Yingying Wang, Zhejiang (CN); Yuefu Ke, Zhejiang (CN); Yi Zhu, Zhejiang (CN)

(73) Assignee: Linhai Meiyang Parasol Industry Co., Ltd, Zhejiang (CN)

( * ) Notice: Subject to any disclaimer, the term of this patent is extended or adjusted under 35 U.S.C. 154(b) by 220 days.

(21) Appl. No.: 17/425,732

(22) PCT Filed: May 18, 2021

(86) PCT No.: PCT/CN2021/094272
§ 371 (c)(1),
(2) Date: Jul. 26, 2021

(87) PCT Pub. No.: WO2022/213451
PCT Pub. Date: Oct. 13, 2022

(65) Prior Publication Data

US 2022/0372764 A1 Nov. 24, 2022

(30) Foreign Application Priority Data

Apr. 9, 2021 (CN) ..... 202120723191.X

(51) Int. Cl.
*E04F 10/10* (2006.01)

(52) U.S. Cl.
CPC ..... *E04F 10/10* (2013.01)

(58) Field of Classification Search
CPC ..... E04F 10/10; E04B 7/163
See application file for complete search history.

(56) References Cited

U.S. PATENT DOCUMENTS 4,527,355 A * 7/1985 Numakami ..... E04F 10/10 49/90.1
5,733,036 A * 3/1998 Montgomery ..... F21V 11/04 362/325

(Continued)

FOREIGN PATENT DOCUMENTS

CN 205617895 U * 10/2016 ..... E04F 10/08
CN 208718489 U * 4/2019

(Continued)

*Primary Examiner* — Beth A Stephan
(74) *Attorney, Agent, or Firm* — JCIPRNET

(57) ABSTRACT

A louver awning with a hidden louver opening and closing driving structure includes an awning frame assembly, a plurality of louvers rotatably mounted on a top portion of the awning frame assembly, linkage bars for linking the louvers, and a louver opening and closing driving structure. The awning frame assembly includes a plurality of columns and ring beams fitted together. The louver opening and closing driving structure comprises a hand-operated mechanism, a transmission assembly and a louver transmission mechanism. The transmission assembly is used to transmit power input by the hand-operated mechanism to the louver transmission mechanism, and the louver transmission mechanism is used to drive the louvers to rotate so as to realize opening and closing of the louvers.

9 Claims, 13 Drawing Sheets

(56) References Cited

U.S. PATENT DOCUMENTS

| | | | | |
|---|---|---|---|---|
| 9,422,715 | B1 * | 8/2016 | Selzer | E04D 11/00 |
| 10,988,926 | B2 * | 4/2021 | Mitchell | E04B 7/163 |
| 10,988,936 | B2 * | 4/2021 | Soetanto | E06B 7/082 |
| 11,421,422 | B2 * | 8/2022 | Zhao | E04F 10/10 |
| 2016/0177575 | A1 * | 6/2016 | Ivic | E04F 10/08 52/302.1 |
| 2018/0127982 | A1 * | 5/2018 | Lemiegre | E04F 10/00 |
| 2021/0010270 | A1 * | 1/2021 | Zhao | E04B 1/163 |
| 2021/0332587 | A1 * | 10/2021 | Geriavenko | E04F 10/10 |

FOREIGN PATENT DOCUMENTS

| | | | |
|---|---|---|---|
| CN | 110043110 A | * | 7/2019 |
| CN | 111794457 | | 10/2020 |

* cited by examiner

LOUVER AWNING WITH HIDDEN LOUVER OPENING AND CLOSING DRIVING STRUCTURE

CROSS-REFERENCE TO RELATED APPLICATION

This application is a 371 of international application of PCT application serial no. PCT/CN2021/094272, filed on May 18, 2021, which claims the priority benefit of China application no. 202120723191.X, filed on Apr. 9, 2021. The entirety of each of the above mentioned patent applications is hereby incorporated by reference herein and made a part of this specification.

BACKGROUND

Technical Field

The invention relates to the field of outdoor products, and in particular to a louver awning with a hidden blind opening and closing driving structure.

Description of Related Art

The louver awning is a common outdoor product. The Chinese patent publication CN111794457A discloses a tent with a central driving long louver roof opening and closing structure. The tent includes an awning frame, a louver group, linkage bars, a louver transmission mechanism, a transmission rod and a driving structure. The awning frame includes two first ring beams and a middle beam. The louver group includes a group of louvers provided in rows, and both ends of the louvers are fitted with the two first ring beams through a first mounting assembly. The middle part of the louver is fitted with the middle beam through a second mounting assembly, and the mounting assemblies comprise a louver fixing seat and a louver rotating part. The tent has the following beneficial effects: the driving structure is mounted on the middle beam, and the driving structure drives the louver transmission mechanism on both sides to open and close the louvers, so that the louvers can be prevented from being twisted. According to the present invention, the louver fixing seat is clamped to be assembled with the first ring beam and the middle beam, so that the assembly mode of the louver is simplified, and the labor cost and the material cost are reduced. However, the louver driving structure in the louver awning is exposed in the middle of the louver awning, which is very conspicuous and not concise in form, so it affects the beauty, and also occupies the space in the awning and affects the use of the louver awning.

SUMMARY

In order to overcome the shortcomings of the prior art, the present invention provides a technical scheme of a louver awning with a hidden blind opening and closing driving structure.

The louver awning with a hidden louver opening and closing driving structure, includes an awning frame assembly, a plurality of louvers rotatably mounted on a top portion of the awning frame assembly, linkage bars for linking the plurality of louvers, and a louver opening and closing driving structure for driving the louvers to open and close. The awning frame assembly comprises a plurality of columns and ring beams fitted together. The louver opening and closing driving structure comprises a hand-operated mechanism fitted on one of the columns, a transmission assembly transmissively coupled to the hand-operated mechanism and a louver transmission mechanism transmissively coupled to the transmission assembly. The transmission assembly is used to transmit power input by the hand-operated mechanism to the louver transmission mechanism, and the louver transmission mechanism is used to drive the louvers to rotate so as to realize opening and closing of the louvers.

The louver awning with a hidden louver opening and closing driving structure is characterized by further comprising a crank connecting rod mechanism. The crank connecting rod mechanism comprises a crank and a connecting rod rotatably coupled to the crank. The crank is used to be transmissively coupled to a second transmission assembly, and the connecting rod is used to be rotatably coupled to the louver. When the second transmission assembly drives the crank to rotate, the crank is capable of driving the louver to rotate through the connecting rod, so as to realize the opening and closing of the louver.

The louver awning with a hidden louver opening and closing driving structure is characterized in that the transmission assembly comprises a first transmission mechanism transmissively coupled to the hand-operated mechanism, a first transmission rod transmissively coupled to the first transmission mechanism and vertically arranged, and a second transmission mechanism transmissively coupled to an upper end of the first transmission rod. The hand-operated mechanism is used to drive the first transmission mechanism to rotate, the first transmission mechanism is used to drive the first transmission rod to rotate, the first transmission rod is used to drive the second transmission mechanism to rotate, and the second transmission mechanism is used to drive the louver transmission mechanism to rotate.

The louver awning with a hidden louver opening and closing driving structure is characterized in that the hand-operated mechanism is fitted on a side of the one of the columns, and the first transmission mechanism, the first transmission rod and the second transmission mechanism are fitted in the one of the columns.

The louver awning with a hidden blind opening and closing driving structure is characterized in that the transmission assembly comprises a first transmission mechanism transmissively coupled to the hand-operated mechanism, a first transmission rod transmissively coupled to the first transmission mechanism and vertically arranged, a third transmission mechanism transmissively coupled to the first transmission rod, a second transmission rod transmissively coupled to the third transmission mechanism and horizontally arranged, and a fourth transmission mechanism transmissively coupled to the second transmission rod. The hand-operated mechanism is used to drive the first transmission mechanism to rotate, the first transmission mechanism is used to drive the first transmission rod to rotate, the first transmission rod is used to drive the third transmission mechanism to rotate, the third transmission mechanism is used to drive the second transmission rod to rotate, the second transmission rod is used to drive the fourth transmission mechanism to rotate, and the fourth transmission mechanism is used to drive the louver transmission mechanism to rotate.

The louver awning with a hidden louver opening and closing driving structure is characterized in that the hand-operated mechanism is fitted on a side of the one of the columns, the first transmission mechanism and the first transmission rod are fitted in the column, and the second transmission rod and the fourth transmission mechanism are fitted in one of the ring beams.

The louver awning with a hidden louver opening and closing driving structure is characterized in that an upper end of each column is fitted with a first profile connector, an end of each ring beam is fitted with a second profile connector, and the first profile connector and the second profile connector are fastened and combined through a protruding and recess structure and are fitted through fasteners, so as to realize quick and firm connection of each column and the ring beams.

The louver awning with a hidden louver opening and closing driving structure is characterized in that the first profile connector is inserted into the upper end of each column, and each column is used to limit the first profile connector in a horizontal direction, such that the first profile connector is unmovable in the horizontal direction.

The louver awning with a hidden louver opening and closing driving structure is characterized in that the upper end of each column is provided with a mounting opening, the mounting opening is provided with a support plate for supporting the first profile connector, and two sides of the mounting opening are provided with limiting blocks, and the first profile connector is inserted into the mounting opening and is limited by the limiting block. A cover plate for covering the mounting opening is provided on each column.

The louver awning with a hidden louver opening and closing driving structure is characterized in that one end of the second profile connector is used to be inserted into the end portion of each ring beam and fitted to each ring beam through fasteners, and the other end of the second profile connector extends out from the end portion of each ring beam and fitted to the first profile connector through fasteners.

The louver awning with a hidden louver opening and closing driving structure is characterized in that louver blades of the louvers have a sunlight plate structure or a cloth structure.

Compared with the prior art, the present invention has the following beneficial effects.

1) The louver opening and closing driving structure of the present invention is mounted on the columns, which can prevent the louver opening and closing driving structure from being exposed in the middle of the louver awning, thus making the appearance of the present invention simpler and more attractive and the space in the awning larger without affecting the use of the louver awning.
2) The vertical column and the ring beam are fitted together through the first profile connector and the second profile connector, so that the mounting structure between the beams and columns is simpler and more reliable, and the disassembly and assembly are more convenient.

DESCRIPTION OF THE EMBODIMENTS

Figure 1:
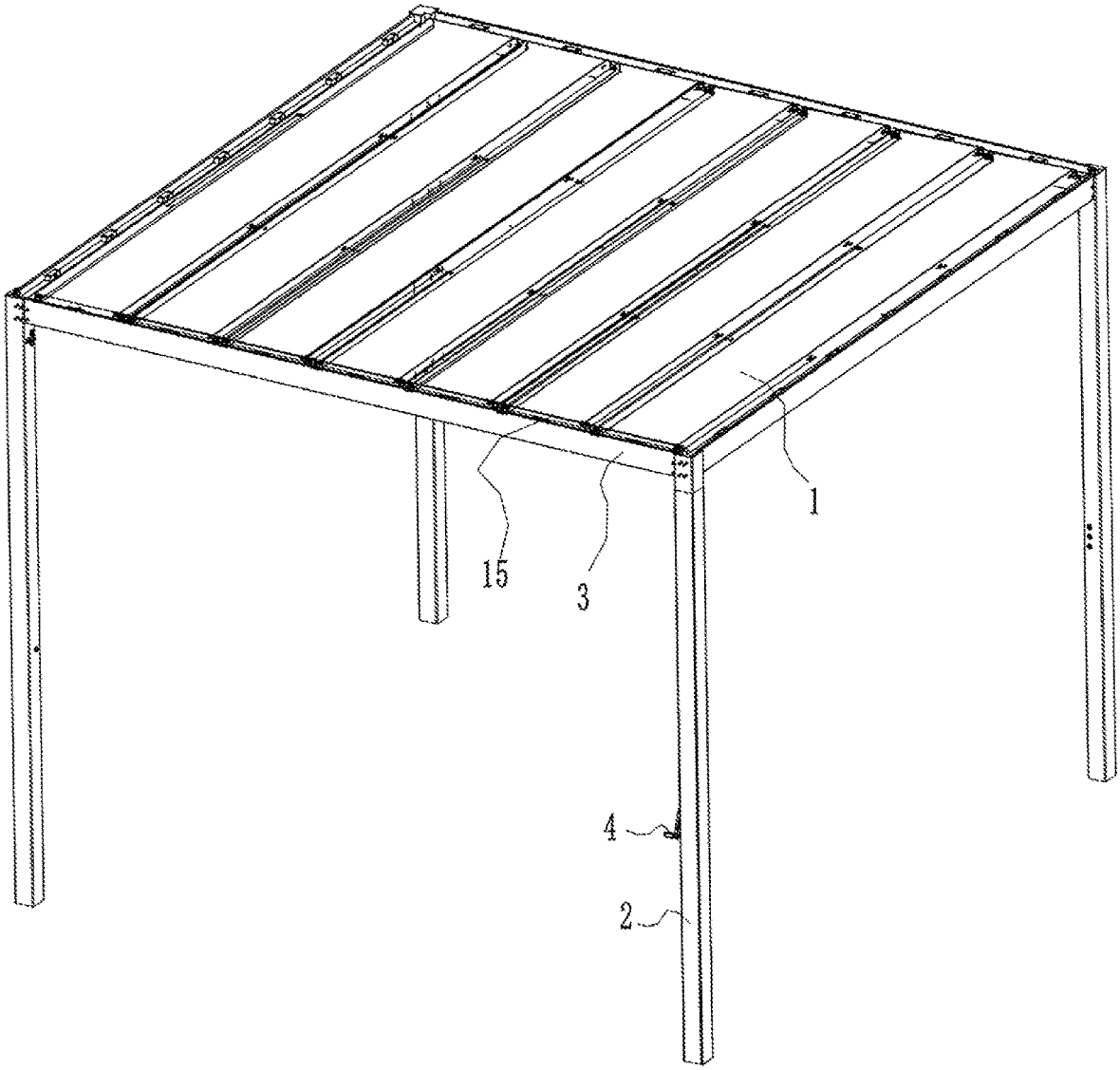
FIG. 1 is a structural schematic diagram of Embodiment 1.

In the description of the present invention, it should be understood that the terms "one end", "the other end", "outer", "upper", "inner", "horizontal", "coaxial", "central", "end" "," "length", "outer end" and the like indicate the orientations or positional relationships based on the orientations or positional relationships shown in the drawings, and are only for the convenience of describing the present invention and simplifying the description, rather than indicating or implying the described device or element must have a specific orientation, be constructed and operated in a specific orientation, and therefore cannot be understood as limiting the present invention.

The present invention will be further described below with reference to the drawings.

Embodiment 1

As shown in FIGS. 1-8, a louver awning with a hidden louver opening and closing driving structure comprises an awning frame assembly, a plurality of louvers 1 rotatably mounted on a top portion of the awning frame assembly, linkage bars 15 for linking the plurality of louvers 1, and a louver opening and closing driving structure for driving the louvers 1 to open and close. The awning frame assembly comprises a plurality of columns 2 and ring beams 3 fitted together. The louver opening and closing driving structure comprises a hand-operated mechanism 4 fitted on one of the columns 2, a transmission assembly transmissively coupled to the hand-operated mechanism 4 and a louver transmission mechanism transmissively coupled to the transmission assembly. The transmission assembly is used to transmit power input by the hand-operated mechanism 4 to the louver transmission mechanism, and the louver transmission mechanism is used to drive the louvers 1 to rotate so as to realize opening and closing of the louvers 1.

As an optimization, the louver transmission mechanism comprises a crank connecting rod mechanism. The crank connecting rod mechanism comprises a crank 6 and a connecting rod 7 rotatably coupled to the crank 6. The crank 6 is used to be transmissively coupled to a second transmission assembly, and the connecting rod 7 is used to be rotatably coupled to the louver 1. When the second transmission assembly drives the crank 6 to rotate, the crank 6 is capable of driving the louvers 1 to rotate through the connecting rod 7, so as to realize the opening and closing of the louvers 1.

Figure 2:
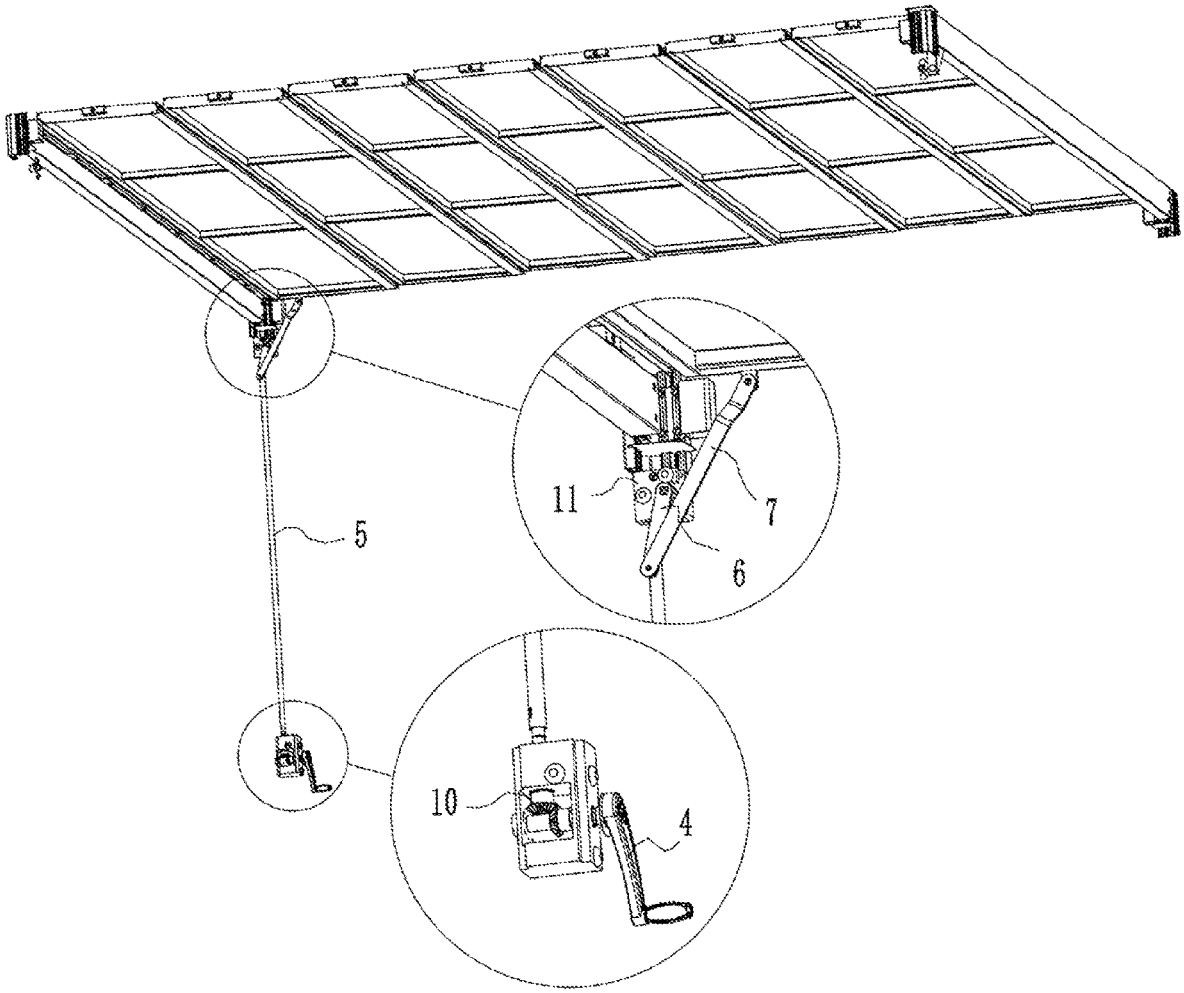
FIG. 2 is a partial structural diagram of Embodiment 1.
Figure 3:
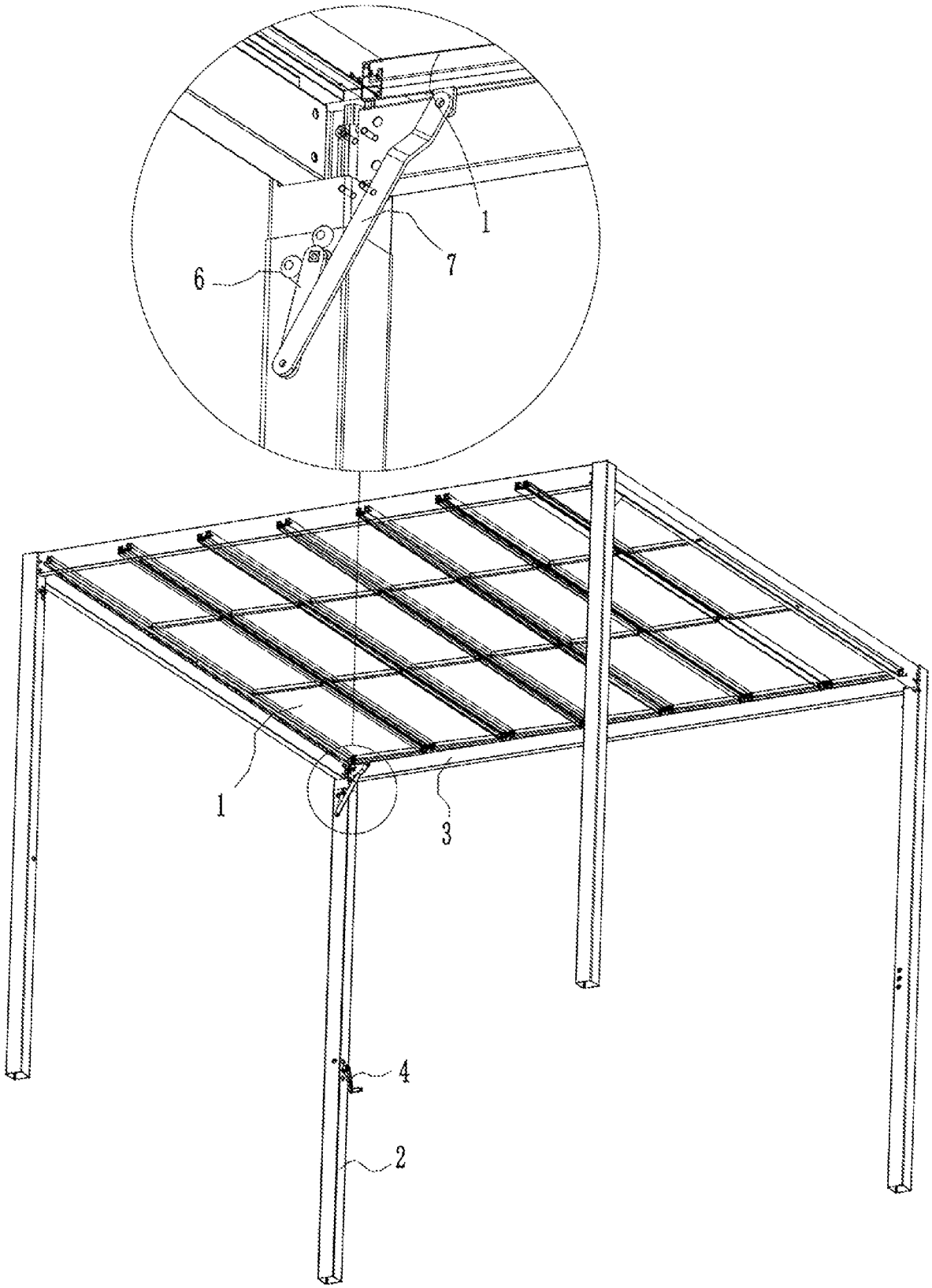
FIG. 3 is another structural schematic diagram of Embodiment 1.
Figure 4:
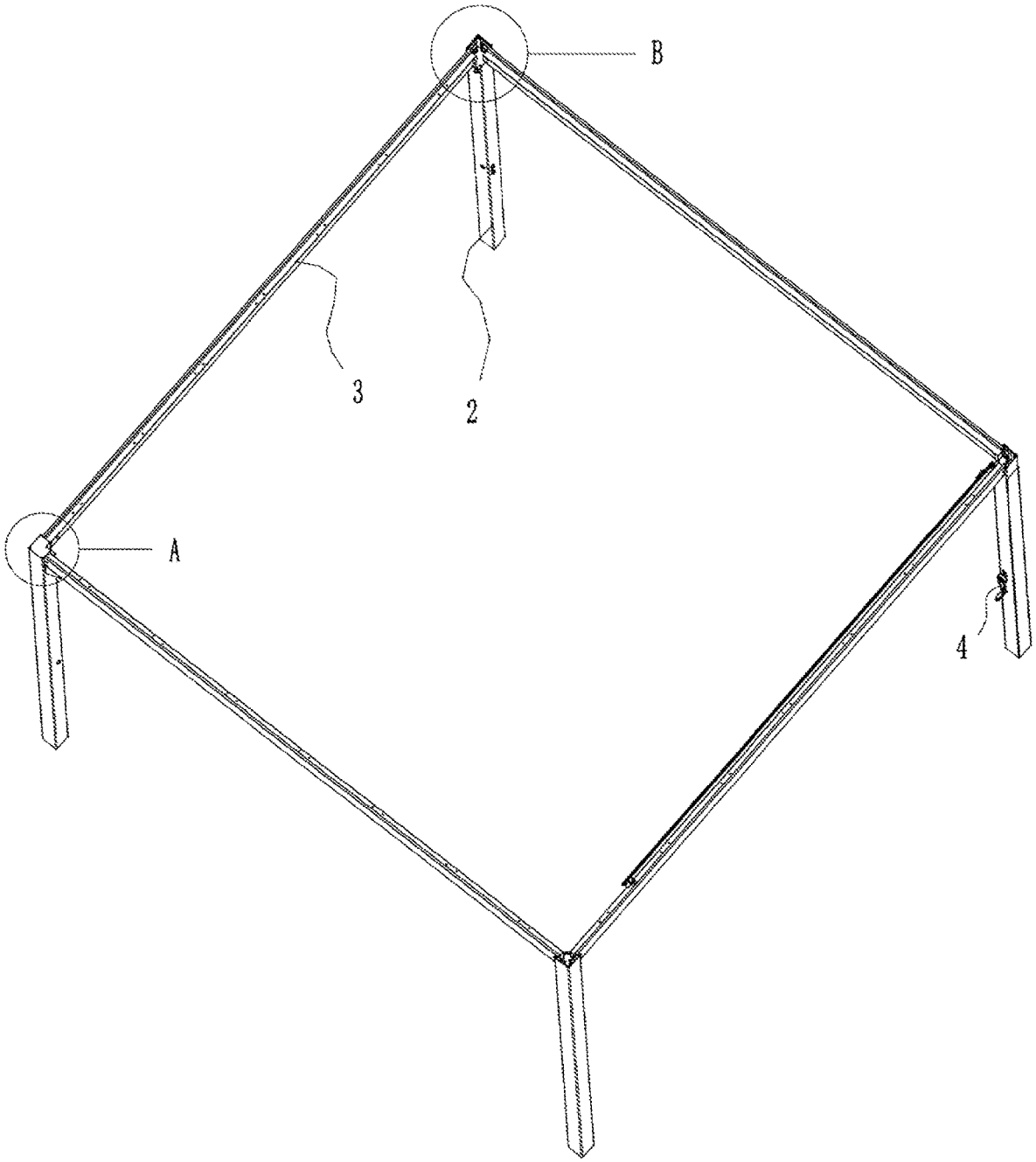
FIG. 4 is a structural schematic diagram of an awning frame assembly in Embodiment 1.
Figure 5:
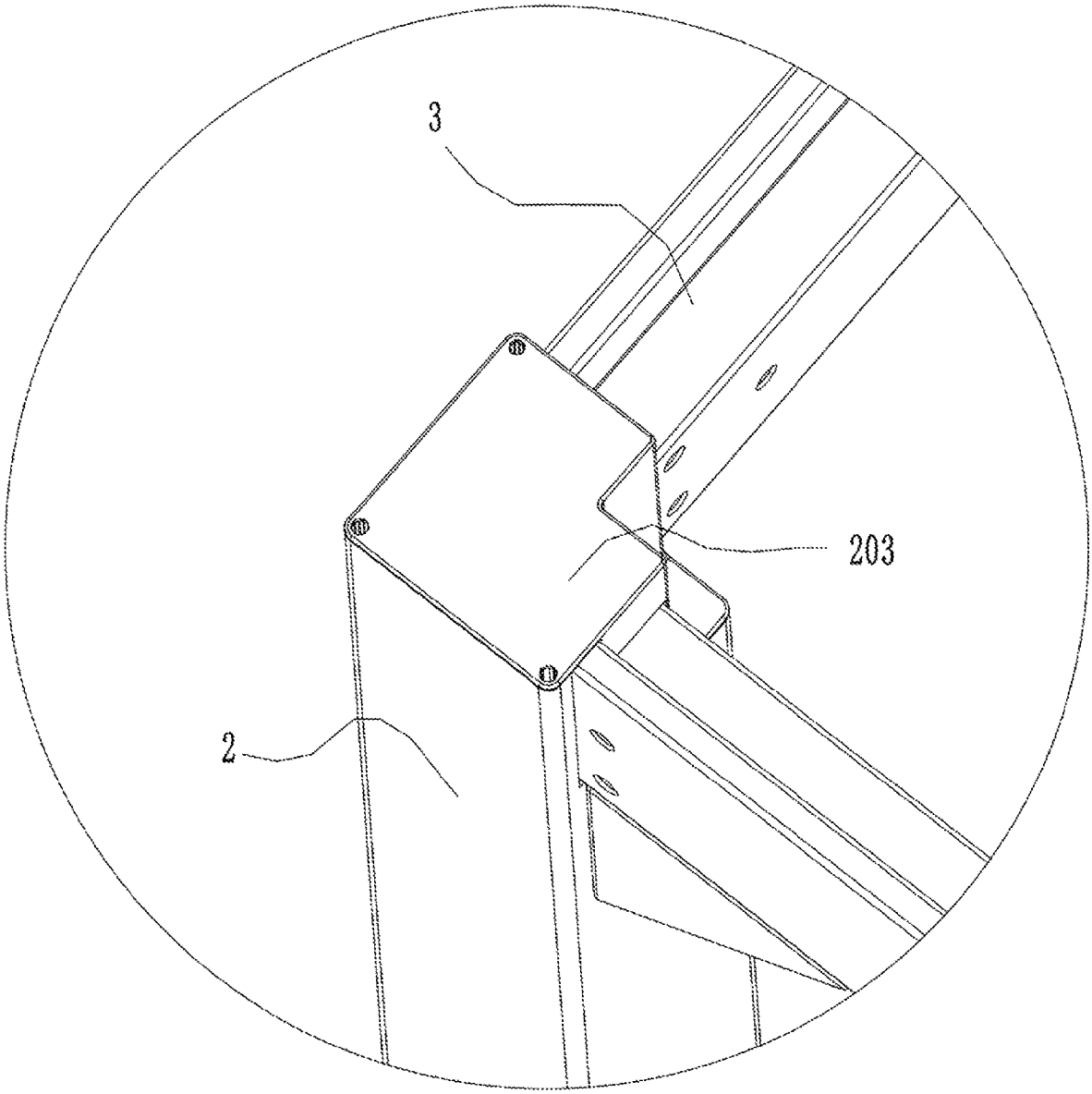
FIG. 5 is an enlarged view of region A in FIG. 4.
Figure 6:
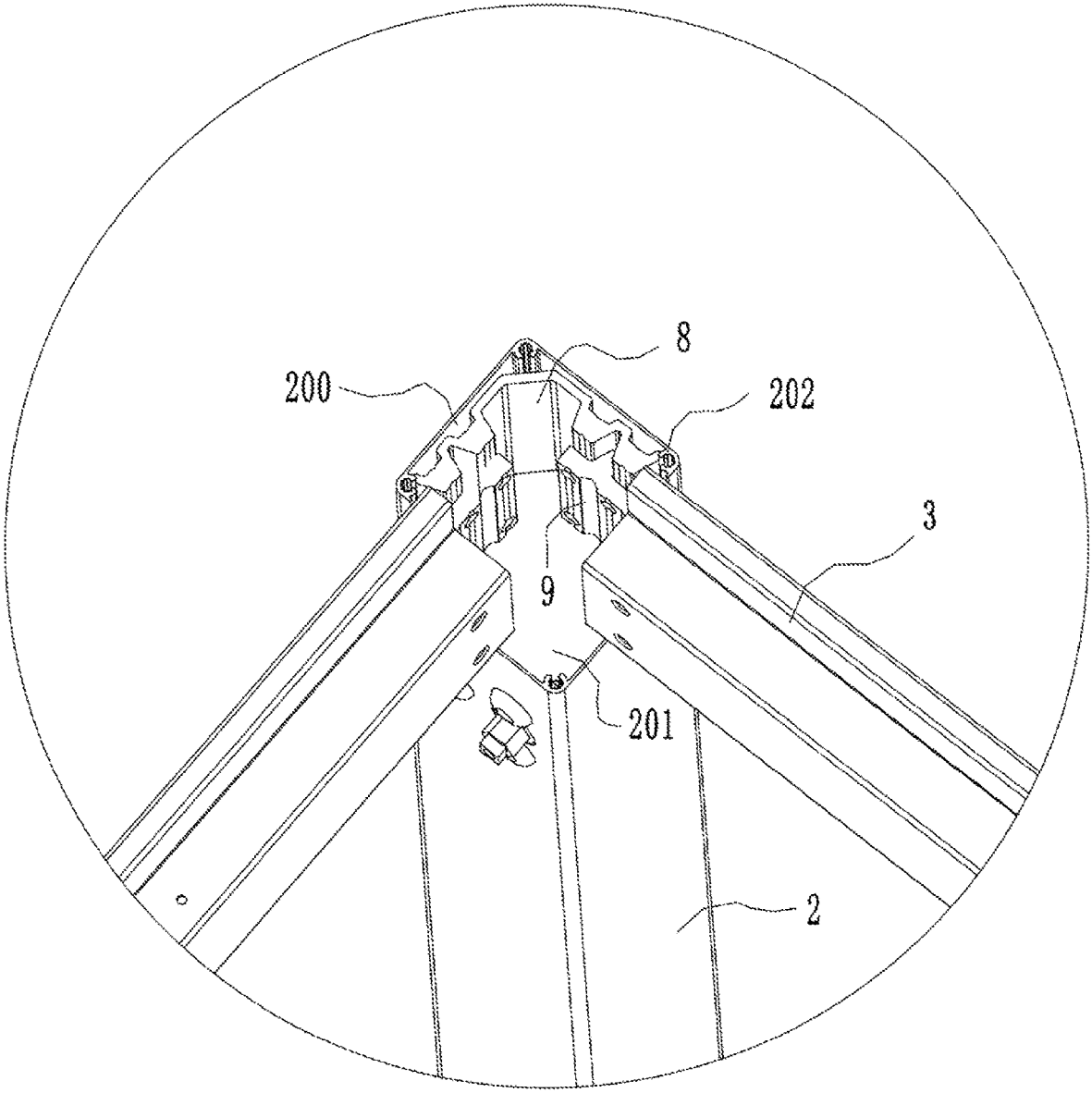
FIG. 6 is an enlarged view of region B in FIG. 4.
Figure 7:
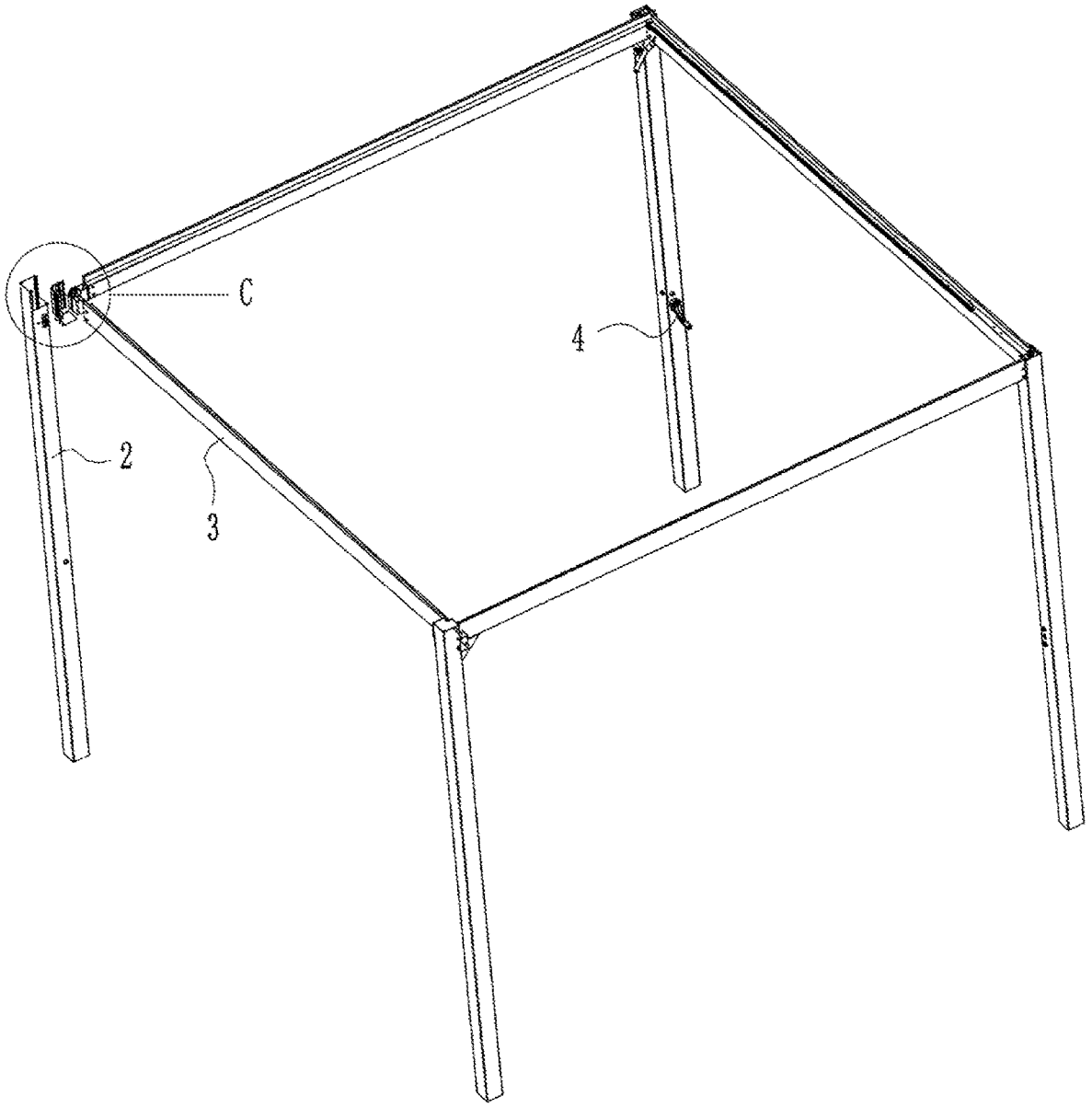
FIG. 7 is another structural schematic diagram of the awning frame assembly in Embodiment 1.
Figure 8:
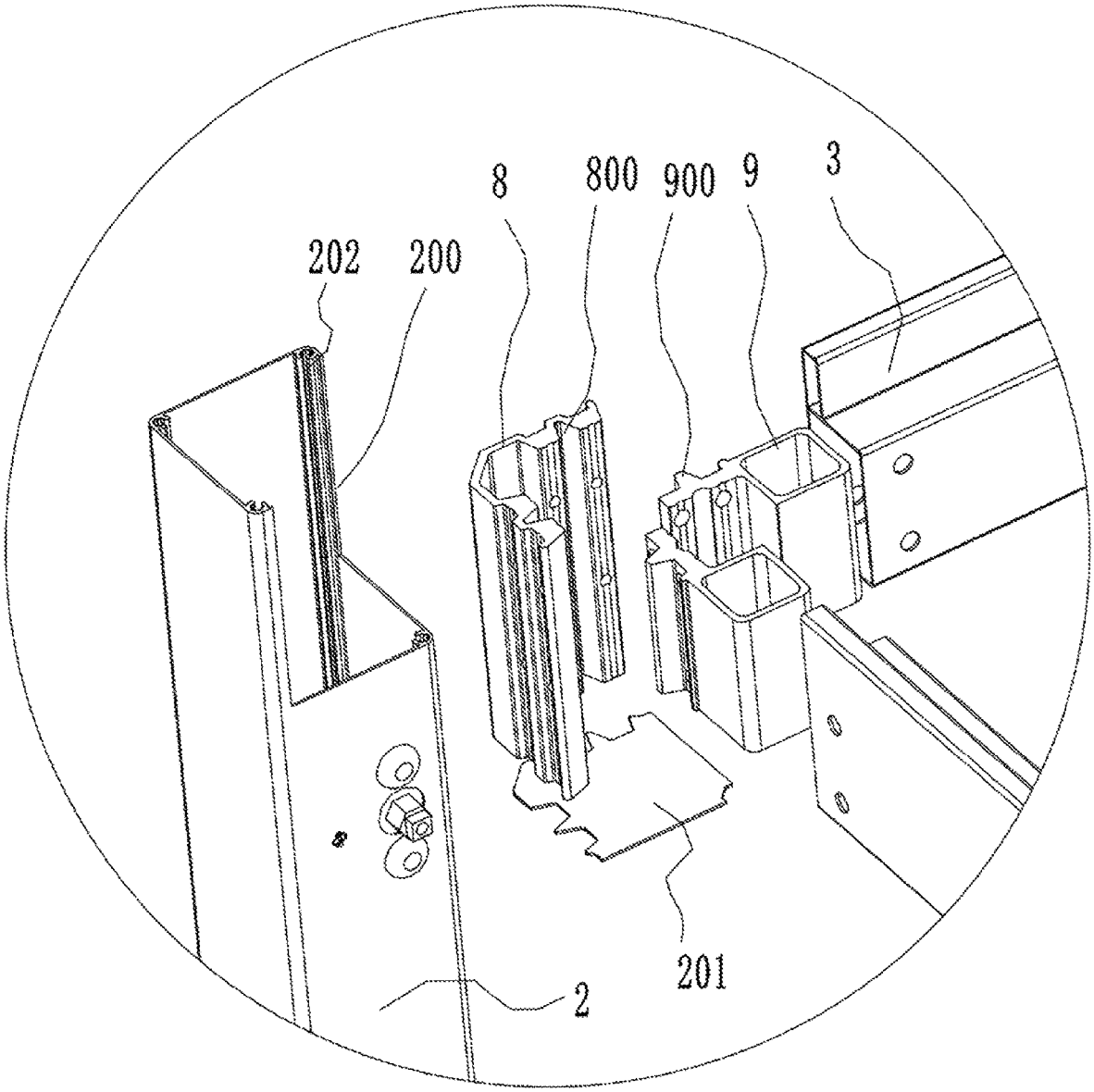
FIG. 8 is an enlarged view of region C in FIG. 7.
Figure 9:
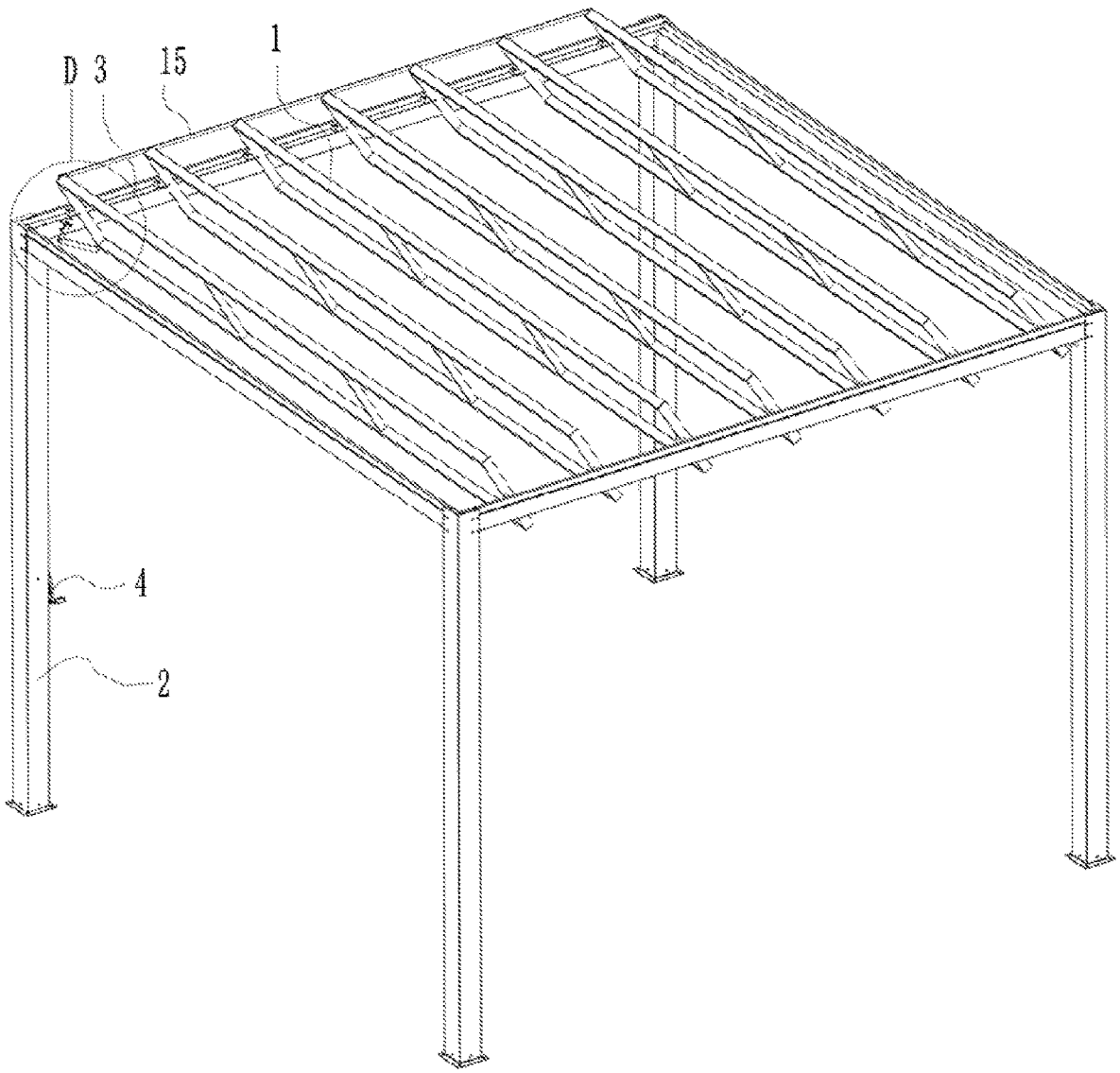
FIG. 9 is a structural diagram of Embodiment 2.
Figure 10:
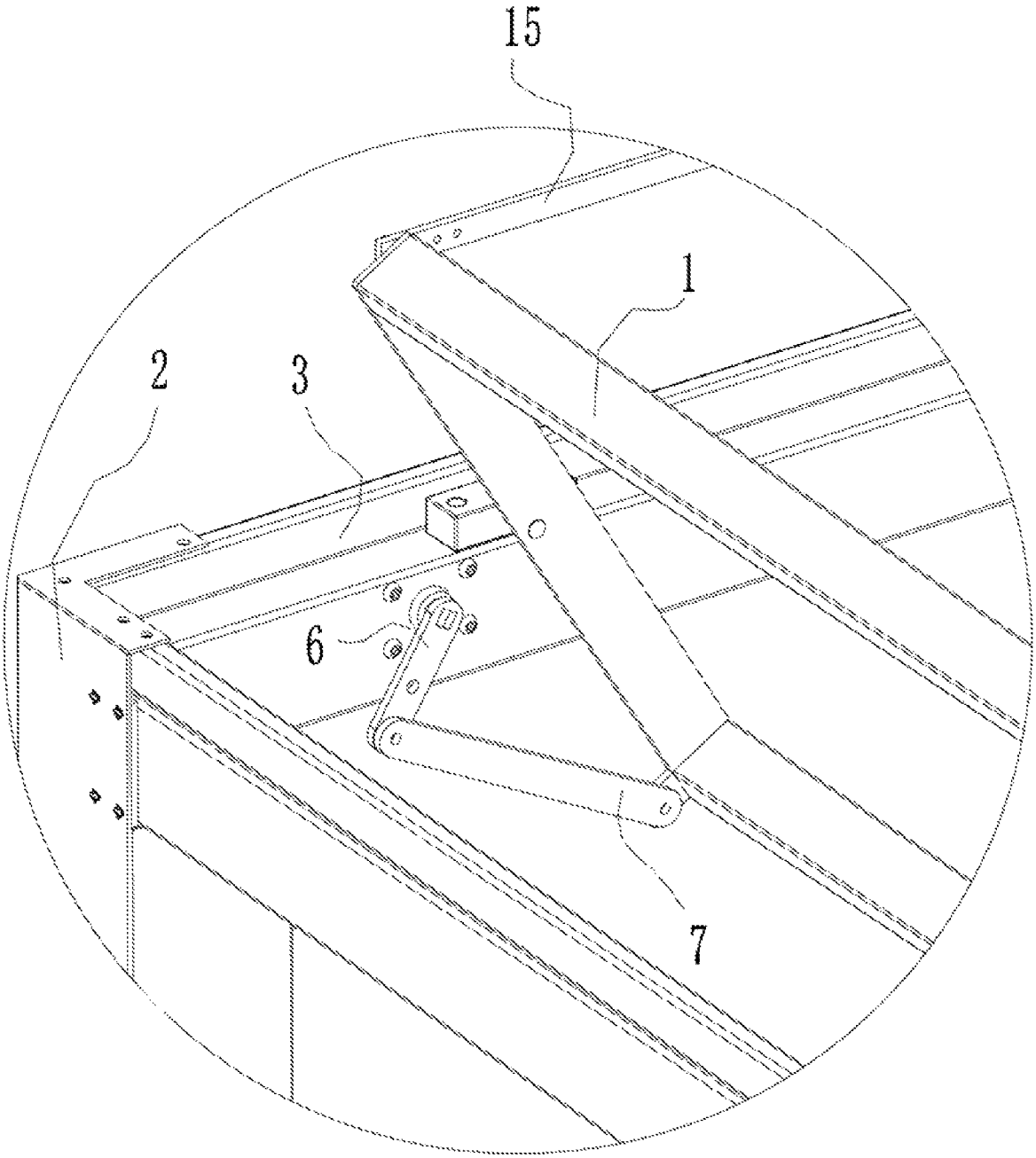
FIG. 10 is an enlarged view of region D in FIG. 9.
Figure 11:
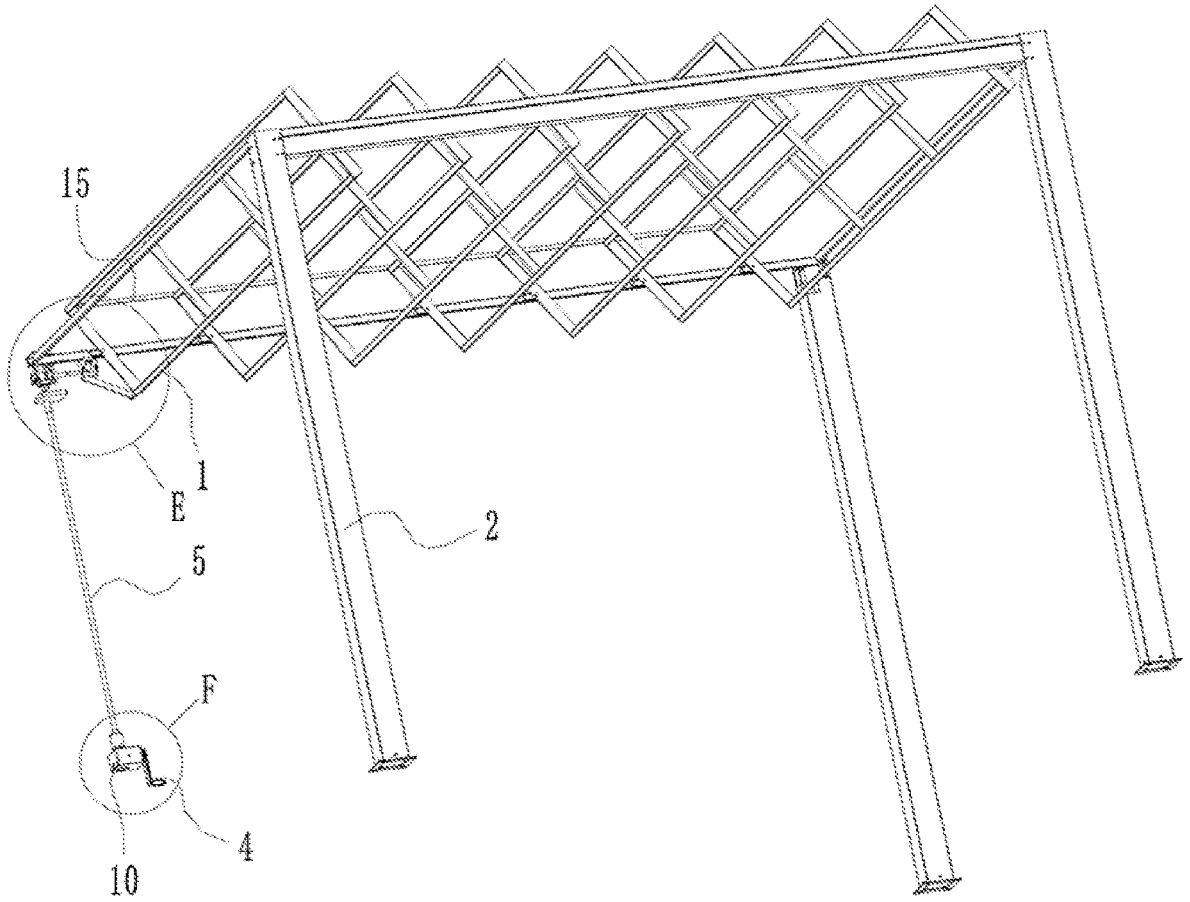
FIG. 11 is a partial structural diagram of Embodiment 2.
Figure 12:
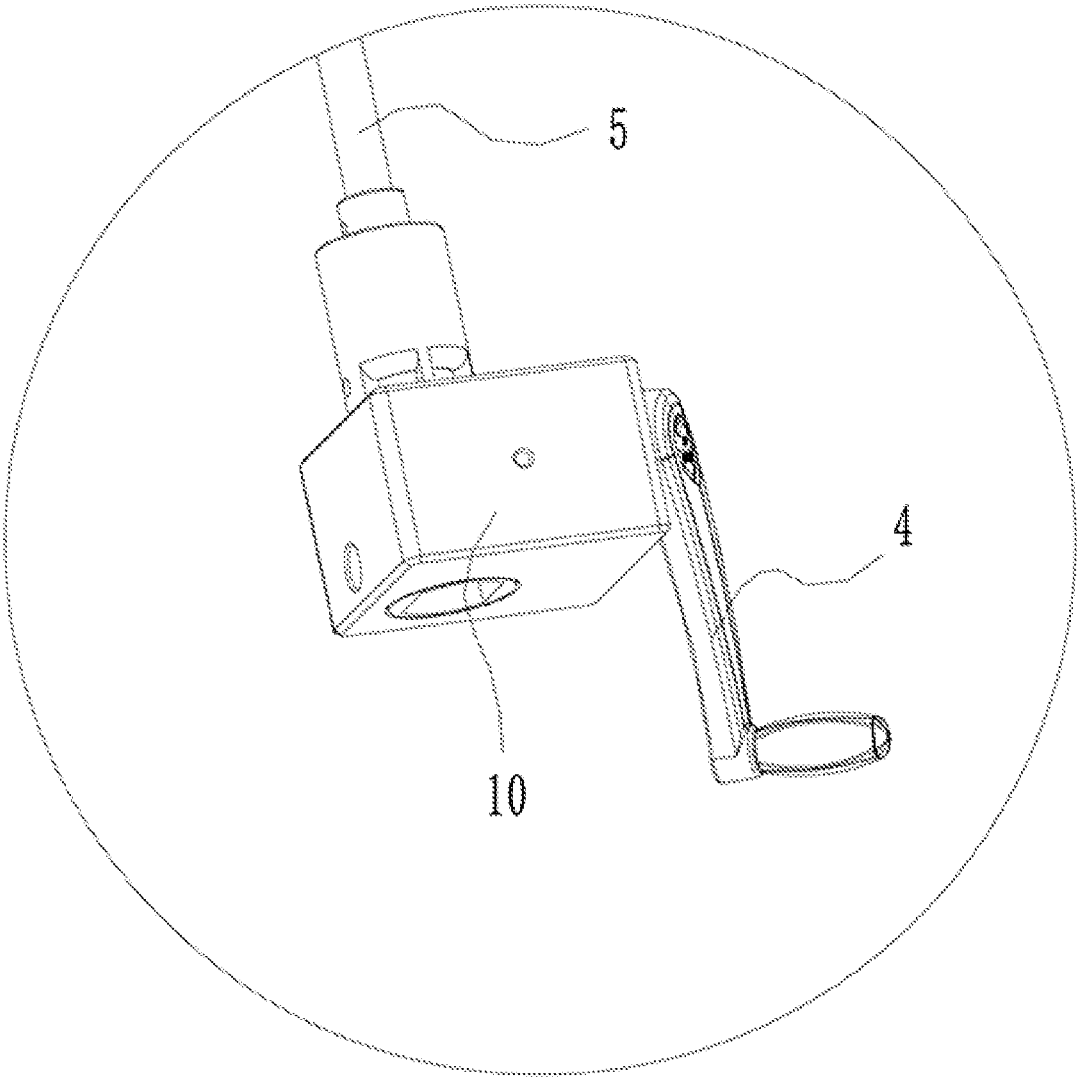
FIG. 12 is an enlarged view of region F in FIG. 11.
Figure 13:
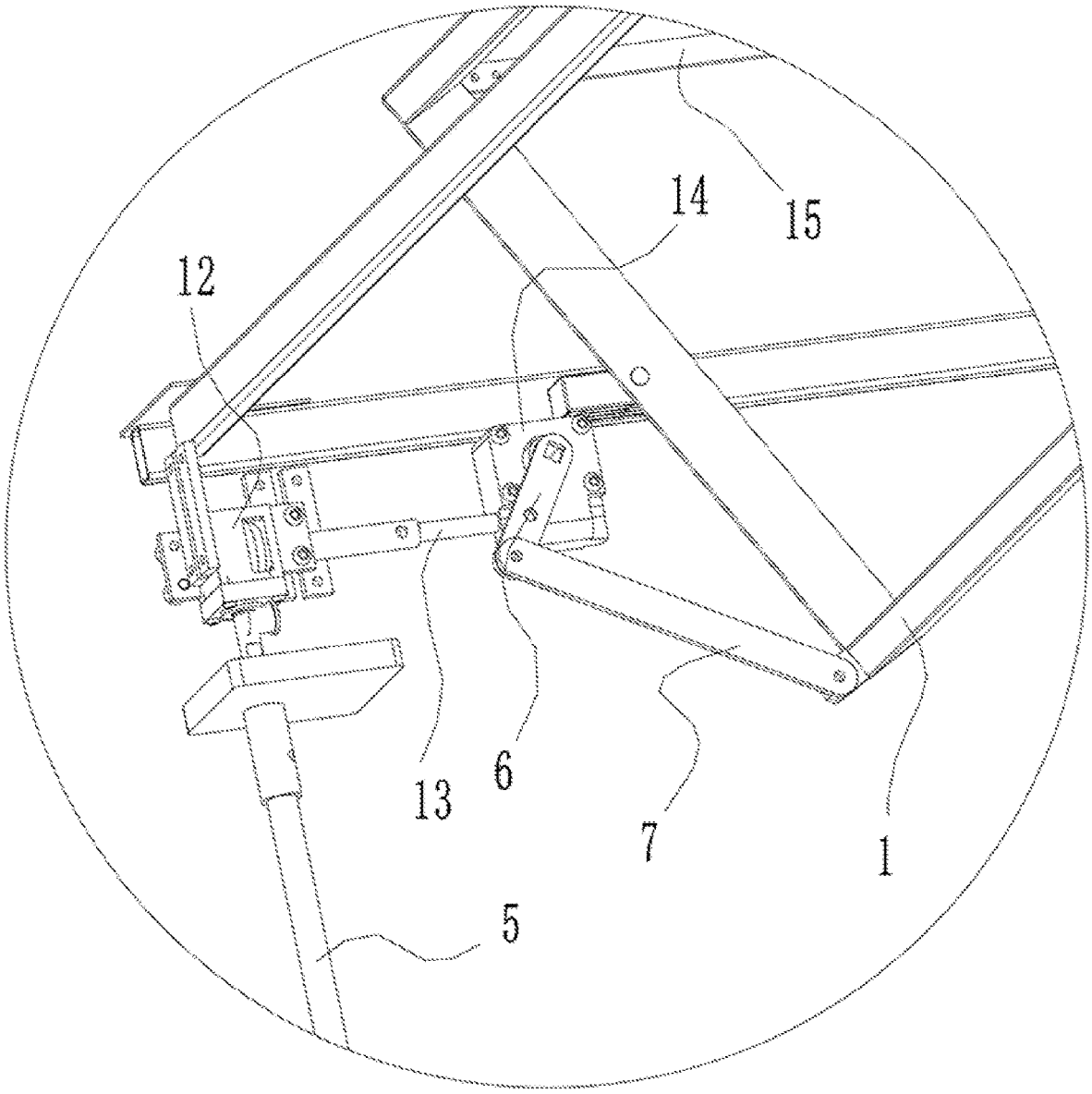
FIG. 13 is an enlarged view of region E in FIG. 11.

As an optimization, the transmission assembly comprises a first transmission mechanism 10 transmissively coupled to the hand-operated mechanism 4, a first transmission rod 5 transmissively coupled to the first transmission mechanism 10 and vertically arranged, and a second transmission mechanism 11 transmissively coupled to an upper end of the first transmission rod 5. The hand-operated mechanism 4 is used to drive the first transmission mechanism 11 to rotate, the first transmission mechanism 11 is used to drive the first transmission rod 5 to rotate, the first transmission rod 5 is used to drive the second transmission mechanism 11 to rotate, and the second transmission mechanism 11 is used to drive the louver transmission mechanism to rotate. The hand-operated mechanism 4 is a hand crank 4, the rotation axis of the hand crank 4 is arranged horizontally, and the first transmission mechanism 10 has a bevel gear transmission structure or a worm gear transmission structure, preferably a bevel gear transmission structure. The lower end of the hand crank 4 and the lower end of the first transmission rod 5 are respectively fixed on two transmission shafts of the bevel gear transmission structure, and the bevel gear transmission structure works by operating the hand crank 4. Since the bevel gear transmission structure is a publicly known technology in the field of machinery, its specific structure is shown in FIG. 2, and will not be described. The bevel gear transmission structure or the worm gear transmission structure of the second transmission mechanism 11 is preferably a worm gear transmission structure. The upper end of the first transmission rod 5 is connected to the worm of the worm gear transmission structure, and the transmission shaft with a worm gear in the worm gear transmission structure is transmissively coupled to the crank 6. Since the worm gear transmission structure is a publicly known technology in the field of machinery, it will not be described.

In the above structure, the first transmission mechanism 10, the first transmission rod 5 and the second transmission mechanism 11 are all fitted in the one of the columns 2, and the second transmission mechanism 11 is specifically located at the upper end of the one of the columns 2.

As an optimization, the upper end of each of the columns 2 is fitted to a first profile connector 8, and the end portion of each of the ring beams 3 is fitted to a second profile connector 9. The first profile connector 8 has an L-shaped structure. The first profile connector 8 of the column 2 and the second profile connector 9 on two adjacent ring beams 3 are fastened and combined through a concave-convex structure and are fitted through fasteners, so as to realize quick and firm connection between the columns 2 and the ring beams 3.

Further, the first profile connector 8 is inserted into the upper end of each of the columns 2, and each of the columns 2 is used to limit the first profile connector 8 in the horizontal direction, such that the first profile connector 8 is unmovable in the horizontal direction.

Further, the upper end of each of the columns 2 is provided with a mounting opening 200 which is formed by openings on both sides of the column 2 corresponding to two adjacent ring beams 3, thus facilitating the ring beams 3 to extend into the column 2. The bottom portion of the mounting opening 200 is fitted to a support plate 201, and two sides of the mounting opening 200 are provided with limiting blocks 202. The first profile connector 8 is inserted into the mounting opening 200, supported on the support plate 201 and limited by the limiting blocks 202. In addition, a cover plate 203 for covering the first profile connector 8, the second profile connector 9 and the mounting opening 200 is also fitted on each of the columns 2.

In the above structure, one end of the second profile connector 9 is a tubular structure, which is inserted into the end portion of the ring beam 3 and fitted to the ring beam 3 through bolts, and the other end of the second profile connector 9 is a plate-like structure, which extends from the end portion of the ring beam 3 and is fitted to the first profile connector 8 through bolts. Specifically, the protruding and recess structure comprises a groove 800 provided on the first profile connector 8 and a protruding rib 900 provided on the second profile connector 9, and the protruding rib 900 is fastened with the groove 800. In addition, the protruding and recess can also be designed in other forms.

As an optimization, the louver blades of the louvers 1 have a sunlight plate structure or a cloth structure, and the cloth structure is mainly nylon, canvas, rain-proof cloth and the like. The sunlight plate structure is mainly made of PC/PET/PMMA/PP material and ABS plus PC material.

During use, the hand-operated mechanism 4 is rotated, which drives the first transmission mechanism 10 to rotate, the first transmission mechanism 10 drives the first transmission rod 5 to rotate, the first transmission rod 5 drives the second transmission mechanism 11 to rotate, the second transmission mechanism drives the louver driving structure to rotate the louvers 1, and the louvers 1 are opened and closed together through the linkage bars 15.

Embodiment 2

As shown in FIGS. 9-13, a louver awning with a hidden louver opening and closing driving structure comprises an awning frame assembly, a plurality of louvers 1 rotatably mounted on a top of the awning frame assembly, linkage bars 15 for linking the plurality of louvers 1, and a louver opening and closing driving structure for driving the louvers 1 to open and close. The awning frame assembly comprises a plurality of columns 2 and ring beams 3 fitted together. The louver opening and closing driving structure comprises a hand-operated mechanism 4 fitted on one of the columns 2, a transmission assembly transmissively coupled to the hand-operated mechanism 4 and a louver transmission mechanism transmissively coupled to the transmission assembly. The transmission assembly is used to transmit power input by the hand-operated mechanism 4 to the louver transmission mechanism, and the louver transmission mechanism is used to drive the louver 1 to rotate so as to realize opening and closing of the louver 1.

As an optimization, the louver transmission mechanism comprises a crank connecting rod mechanism. The crank connecting rod mechanism comprises a crank 6 and a connecting rod 7 rotatably coupled to the crank 6. The crank 6 is used to be transmissively coupled to a second transmission assembly, and the connecting rod 7 is used to be rotatably coupled to the louver 1. When the second transmission assembly drives the crank 6 to rotate, the crank 6 is capable of driving the louvers 1 to rotate through the connecting rod 7, so as to realize the opening and closing of the louvers 1.

As an optimization, the transmission assembly comprises a first transmission mechanism 10 transmissively coupled to the hand-operated mechanism 4, a first transmission rod 5 transmissively coupled to the first transmission mechanism 10 and vertically arranged, a third transmission mechanism 12 transmissively coupled to the first transmission rod 5, a second transmission rod 13 transmissively coupled to the third transmission mechanism 12 and horizontally arranged, and a fourth transmission mechanism 14 transmissively coupled to the second transmission rod 13. The hand-operated mechanism 4 is used to drive the first transmission mechanism 10 to rotate, the first transmission mechanism 10 is used to drive the first transmission rod 5 to rotate, the first transmission rod 5 is used to drive the third transmission mechanism 12 to rotate, the third transmission mechanism 12 is used to drive the second transmission rod 13 to rotate, the second transmission rod 13 is used to drive the fourth transmission mechanism 14 to rotate, and the fourth transmission mechanism 14 is used to drive the louver transmission mechanism to rotate. The hand-operated mechanism 4 is a hand crank 4, the rotation axis of the hand crank 4 is horizontally arranged, and the first transmission mechanism 10 has a bevel gear transmission structure or a worm gear transmission structure, preferably a bevel gear transmission structure. The lower ends of the hand crank 4 and the first transmission rod 5 are respectively transmissively coupled to two transmission shafts, which have bevel gears, of the bevel gear transmission structure, and the bevel gear transmission structure works by operating the hand crank 4. Since the bevel gear transmission structure is a publicly known technology in the field of machinery, its specific structure is shown in FIG. 2, and will not be described. The third transmission mechanism 12 is a bevel gear transmission structure or a worm gear transmission structure, preferably a bevel gear transmission structure. The upper end of the first transmission rod 5 and the second transmission rod 13 are respectively transmissively coupled to two transmission shafts with bevel gears. Since the bevel gear transmission structure is a publicly known technology in the field of machinery, it will not be described. The fourth transmission mechanism 14 is a bevel gear transmission structure or a worm gear transmission structure, preferably a worm gear transmission structure. The second transmission rod 13 is connected to a worm of the worm gear transmission structure, and a transmission shaft with a worm gear in the worm gear transmission structure is transmissively coupled to the crank 6. Since the worm gear transmission structure is a publicly known technology in the field of machinery, it will not be described.

In the above structure, the hand-operated mechanism 4 is fitted on the side of the column 2, the first transmission mechanism 10 and the first transmission rod 5 are fitted in the column 2, the third transmission mechanism 12 is fitted at the joint between the column 2 and the ring beam 3, and the second transmission rod 13 and the fourth transmission mechanism 14 are fitted in the ring beam 3.

As an optimization, the louver blades of the louver 1 have a sunlight plate structure or a cloth structure, and the cloth structure is mainly nylon, canvas, rain-proof cloth and the like. The sunlight plate structure is mainly made of PC/PET/PMMA/PP material and ABS plus PC material.

During use, the hand-operated mechanism 4 is rotated to drive the first transmission mechanism 10 to rotate, which drives the first transmission rod 5 to rotate, which drives the third transmission mechanism 12 to rotate, the third transmission rod 13 drives the fourth transmission mechanism 14 to rotate, and the fourth transmission mechanism 14 drives the louver transmission mechanism to rotate, which drives the louvers 1 to rotate through linkage bars 15.

Embodiment 3

The difference between this embodiment and Embodiment 1 is that the transmission assembly is a timing belt mechanism which is fitted in one of the columns 2 in this embodiment. One synchronous wheel is located at the lower end of the column 2 and is transmissively coupled to the hand-operated mechanism 4, while the other synchronous wheel is located at the upper end of the column 2 and is transmissively coupled to the louver transmission mechanism.

During use, the timing belt mechanism is driven to rotate by operating the hand-operated mechanism 4, and the timing belt mechanism drives the louver driving structure to rotate, so as to realize the opening and closing of the louver 1.

Embodiment 4

The difference between this embodiment and Embodiment 3 is that the timing belt mechanism is substituted by a sprocket mechanism, and its structure is similar to that of the timing belt mechanism, and its working principle is the same, so it will not be described again.

Finally, it should be noted that the above embodiments are only used to illustrate the technical schemes of the present invention, but not to limit them. Although the present invention has been described in detail with reference to the foregoing embodiments, those of ordinary skill in the art should understand that the technical schemes described in the foregoing embodiments can still be modified, or some or all of the technical features can be equivalently substituted. However, these modifications or substitutions do not make the essence of the corresponding technical schemes deviate from the scope of the technical schemes of embodiments of the present invention.

What is claimed is:

1. A louver awning with a hidden louver opening and closing driving structure, the louver awning comprising an awning frame assembly, a plurality of louvers rotatably mounted on a top portion of the awning frame assembly, linkage bars for linking the plurality of louvers, and a louver opening and closing driving structure for driving the louvers to open and close, wherein the awning frame assembly comprises a plurality of columns and ring beams fitted together, wherein the louver opening and closing driving structure comprises a hand-operated mechanism fitted on one of the columns, a transmission assembly transmissively coupled to the hand-operated mechanism and a louver transmission mechanism transmissively coupled to the transmission assembly; the transmission assembly is configured to transmit power input by the hand-operated mechanism to the louver transmission mechanism, and the louver transmission mechanism is configured to drive the louvers to rotate so as to realize opening and closing of the louvers, wherein the louver transmission mechanism further comprises a crank connecting rod mechanism, the crank connecting rod mechanism comprises a crank and a connecting rod rotatably coupled to the crank, the crank is configured to be transmissively coupled to a second transmission assembly, the connecting rod is configured to be rotatably coupled to the louvers; when the second transmission assembly drives the crank to rotate, the crank is capable of driving the louvers to rotate through the connecting rod, so as to realize the opening and closing of the louvers.

2. The louver awning with a hidden blind opening and closing driving structure according to claim 1, wherein louver blades of the louvers have a sunlight plate structure or a cloth structure.

3. The louver awning with a hidden louver opening and closing driving structure according to claim 1, wherein the transmission assembly comprises a first transmission mechanism transmissively coupled to the hand-operated mechanism, a first transmission rod transmissively coupled to the first transmission mechanism and vertically arranged, and a second transmission mechanism transmissively coupled to an upper end of the first transmission rod; the hand-operated mechanism is configured to drive the first transmission mechanism to rotate, the first transmission mechanism is configured to drive the first transmission rod to rotate, the first transmission rod is configured to drive the second transmission mechanism to rotate, and the second transmission mechanism is configured to drive the louver transmission mechanism to rotate.

4. The louver awning with a hidden louver opening and closing driving structure according to claim 3, wherein the hand-operated mechanism is fitted on a side of the one of the columns, and the first transmission mechanism, the first transmission rod and the second transmission mechanism are fitted in the one of the columns.

5. The louver awning with a hidden blind opening and closing driving structure according to claim 1, wherein the transmission assembly comprises a first transmission mechanism transmissively coupled to the hand-operated mechanism, a first transmission rod transmissively coupled to the first transmission mechanism and vertically arranged, a third transmission mechanism transmissively coupled to the first transmission rod, a second transmission rod transmissively coupled to the third transmission mechanism and horizontally arranged, and a fourth transmission mechanism transmissively coupled to the second transmission rod;

the hand-operated mechanism is configured to drive the first transmission mechanism to rotate, the first transmission mechanism is configured to drive the first transmission rod to rotate, the first transmission rod is configured to drive the third transmission mechanism to rotate, the third transmission mechanism is configured to drive the second transmission rod to rotate, the second transmission rod is configured to drive the fourth transmission mechanism to rotate, and the fourth transmission mechanism is configured to drive the louver transmission mechanism to rotate.

6. The louver awning with a hidden louver opening and closing driving structure according to claim 5, wherein the hand-operated mechanism is fitted on a side of the one of the columns, the first transmission mechanism and the first transmission rod are fitted in the one of the columns, and the second transmission rod and the fourth transmission mechanism are fitted in one of the ring beams.

7. The louver awning with a hidden louver opening and closing driving structure according to claim 1, wherein an upper end of each of the columns is fitted with a first profile connector, an end portion of each of the ring beams is fitted with a second profile connector, and the first profile connector and the second profile connectors are fastened and combined through a protruding and recess structure and are fitted through fasteners, so as to realize connection of each of the columns and the corresponding ring beams.

8. The louver awning with a hidden louver opening and closing driving structure according to claim 7, wherein the first profile connector is inserted into the upper end of each of the columns, and each of the columns is configured to limit the first profile connector in a horizontal direction, such that the first profile connector is unmovable in the horizontal direction.

9. The louver awning with a hidden louver opening and closing driving structure according to claim 7, wherein one end of the second profile connector is configured to be inserted into the end portion of each of the ring beams and fitted to the ring beam through fasteners, and the other end of the second profile connector extends out from the end portion of each of the ring beams and fitted to the first profile connector through fasteners.

* * * * *